United States Patent [19]

Juergens

[11] 4,007,959

[45] Feb. 15, 1977

[54] WHEELCHAIR

[76] Inventor: Eugene H. Juergens, W 75 N758 Tower Ave., Cedarburg, Wis. 53012

[22] Filed: July 7, 1975

[21] Appl. No.: 593,846

[52] U.S. Cl. ..... 297/42; 4/134; 297/44; 297/DIG. 4; 280/42

[51] Int. Cl.[2] ..... A47C 4/00

[58] Field of Search ..... 297/440, 443, 42, 44, 297/45, DIG. 4; 4/134; 108/83, 89; 280/42, 647–650, 242 WC

[56] References Cited

UNITED STATES PATENTS

| | | | |
|---|---|---|---|
| 871,022 | 11/1907 | Anthony | 297/440 X |
| 1,256,936 | 2/1918 | Shaver | 297/440 X |
| 1,381,136 | 6/1921 | Ribeiro | 297/45 |
| 2,116,171 | 5/1938 | Harris | 5/91 |
| 2,450,301 | 9/1948 | Quiggle | 297/44 |
| 2,485,016 | 10/1949 | Rideout | 297/45 |
| 2,621,711 | 12/1952 | Leslie | 297/44 X |
| 2,872,689 | 2/1959 | Fournet | 5/90 |
| 2,880,783 | 4/1959 | Schwinn | 4/134 |
| 3,271,785 | 9/1966 | DuBose | 4/134 |
| 3,810,658 | 5/1974 | Weimer, Sr. | 280/242 WC X |
| 3,869,171 | 3/1975 | Wilson | 297/DIG. 4 X |

*Primary Examiner*—Roy D. Frazier
*Assistant Examiner*—William E. Lyddane
*Attorney, Agent, or Firm*—Willis B. Swartwout, III

[57] ABSTRACT

The present invention comprises a wheelchair for the physically or mentally handicapped wherein cross brace structure extending between the sides of the wheelchair is provided below the seat adjacent the front thereof and additional cross brace structure is provided extending between the sides of the chair across the back above seat level so that said chair structure can be backed over a water closet and further wherein said seat includes a plurality of sections one of which can be withdrawn from beneath a user without loss of body support enabling a handicapped user to eliminate body wastes without assistance or embarrassment.

7 Claims, 5 Drawing Figures

WHEELCHAIR

Figure 1:
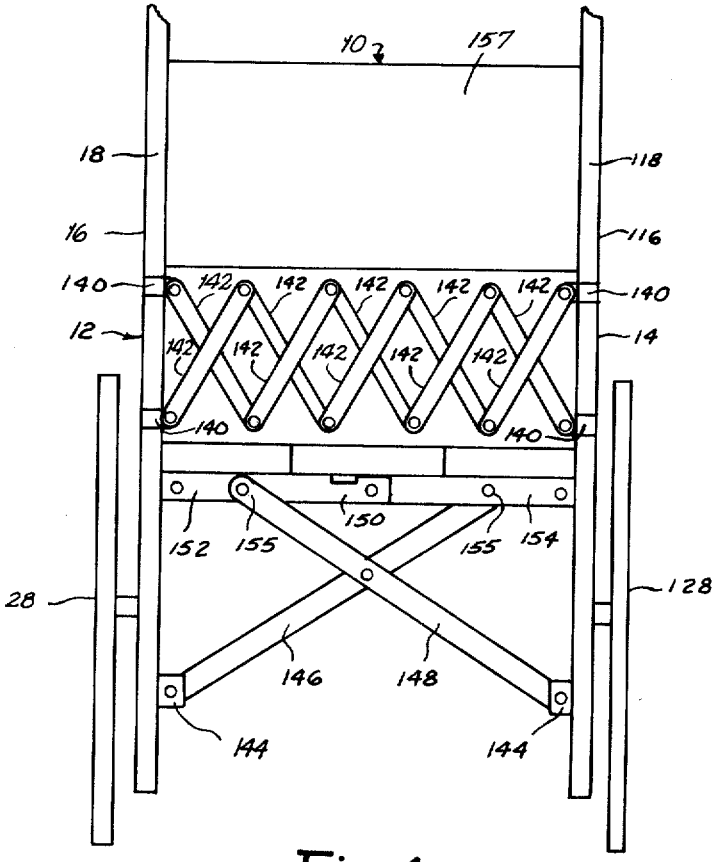

In the past handicapped persons have had problems eliminating body wastes when in a wheel chair. Most often wheel chair occupants needed assistance to get out of the chain and onto the water closet. Some handicapped persons required walkers or support structure on the water closet in addition. This kind of situation was not only inconvenient and embarrassing at home but led to reluctance to visit or travel. Also persons who are handicapped to the extent of being temporarily or permanently confined to the use of a wheelchair have problems relative to the elimination of body wastes. The difficulty or embarrassment described above often so discourages the handicapped person that elimination of wastes becomes psychologically impossible, further and seriously complicating existing health problems.

The present invention overcomes the above problems by providing pivotally and slidable foldable support structure for a collapsible wheelchair which is disposed relative to the frame in positions which provide the required structural support and rigidity while at the same time clearing the space below the seat from the back of the chain towards the front a sufficient distance so that the chair can be backed up over a water closet of the ordinary type in use. The seat structure includes a pad composed of three sections, and the center section can be moved slidably forwardly relative to the chair by the occupant enabling the occupant to use the water closet to dispose of body wastes without difficulty or embarrassment.

It is an object, therefore, of the present invention to provide in a collapsible wheelchair pivotally foldable and slidable cross-support structure between the side members, disposed relative to the side members such that the area between the side members below the seat level from the back of the chain towards the front is free of structural members.

It is further an object of the present invention to provide a wheelchain of the character described wherein the seat structure includes a plurality of cushion sections, one of said sections disposed across the central seat area and manually slidable from beneath the occupant without substantial loss of seat support.

Various other objects and advantages of the present invention will become apparent as this description proceeds as will various modifications or changes to the structure of the present invention which can be made without departing from the spirit thereof. Such additional objects and advantages as well as such modifications and changes are intended to be covered by the scope of the appended claims.

Figure 5:
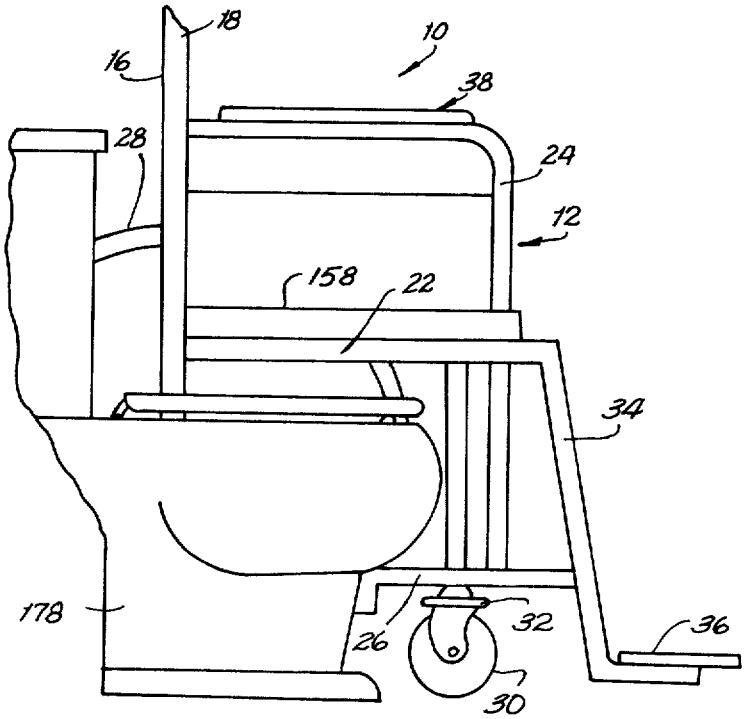
Figure 3:
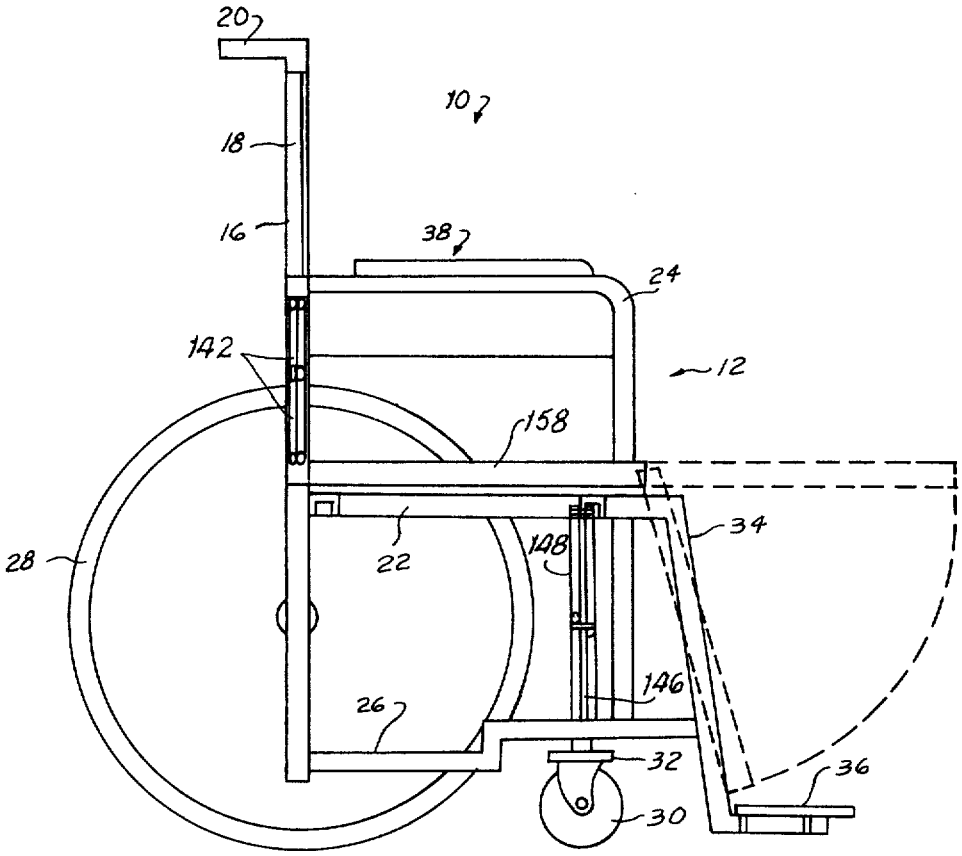
Figure 2:
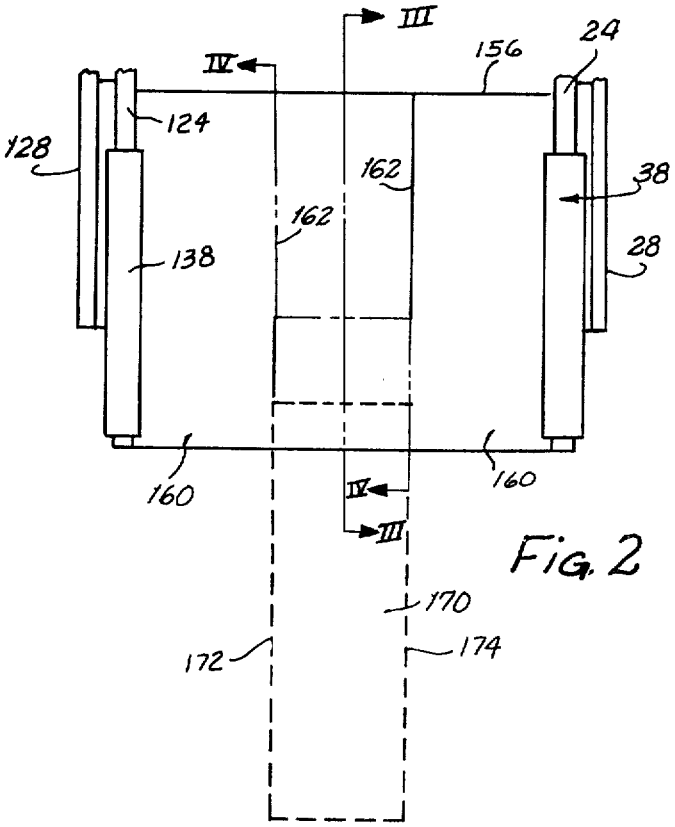
Figure 4:
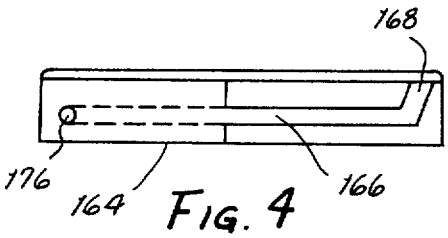

In the drawings:

FIG. 1, is a rear elevational view of a wheelchair structure embodying the present invention with portions at the extreme top broken away, FIG. 2, is a top plan view of the chair structure of the present invention with portions broken away, FIG. 3, is a vertical cross-sectional view of the chair structure taken along line III—III of FIG. 2, FIG. 4, is a vertical cross-sectional view of the seat structure taken along line IV—IV of FIG. 2, and FIG. 5, is a vertical cross-sectional view of the chair structure of the present invention shown in place over a water closet.

Referring now to the drawings, and more particularly to FIGS. 1 and 3 thereof a wheelchair is shown and generally identified by the numeral 10. Chair 10 includes a pair of side assemblies generally identified as numerals 12 and 14 respectively. Assembly 12 is on the left as viewed in FIG. 1 and assembly 14 is on the right. Each assembly 12 and 14 is composed of a plurality of tubular metal members welded or otherwise joined together to form a frame 16. Viewing FIG. 3, frame 16 includes an elongated vertical tubular upright 18 bent into a 7-shape to form a handle 20 at the upper extremity. Intermediate handle 20 and the opposite extremity of upright 18 a frame seat support member 22 is coupled at one end to upright 18, ordinarily by welding. Support member 22 is perpendicular to upright 18 at the point of joinder therewith and extends therefrom forwardly as viewed in FIG. 3. An arm rest support member 24 is coupled at one end to upright 18, intermediate handle 20 and seat support 22. Arm rest support member 24 is perpendicular to upright 18 at the point of joinder and extends forwardly therefrom to a 90° curved bend downward. Seat support 22 and arm rest support 24 lie in the same vertical plane and the bend in arm rest support 24 is approximately above the end of seat support 22 remote from upright 18. Arm rest support 24 is elongated and substantially longer than seat support 22. The bend in support member 24 is at about the median point in arm rest support 24 and the portion of member 24 on the side of the bend remote from upright 18 is parallel to upright 18 and in the same vertical plane and terminates in a horizontal plane adjacent to and slightly above the horizontal plane of termination of upright 18 remote from handle 20. Intermediate the bend in arm rest support 24 and the plane of termination seat support 22 is joined to arm rest support 24, perpendicular thereto. An elongated lower side support 26 is joined at one end to upright 18 adjacent to the plane of termination of the lowermost extremity of upright 18 and extends therefrom in the same vertical plane as seat support 22 and arm rest support 24 perpendicularly joining the end of support 24 remote from upright 18 in a horizontal plane adjacent and slightly above the plane of termination of the end of upright 18 remote from handle 20, and extending beyond the extremity of arm rest support 24 perpendicularly thereto.

A large wheel 28 rotatably coupled to upright 18 intermediate the point of joinder of upright 18 with one end of frame seat support member 22 and the point of joinder of upright 18 with one end of elongated lower side support 26. A caster wheel 30 is mounted on a caster assembly 32 which is joined to the bottom surface of lower side support 26 intermediate the joinder of one end of lower side support 26 with upright 18 and the joinder of side support 26 with the portion of arm rest support remote from upright 18 but caster assembly 32 is disposed in adjacent relationship to the latter joinder.

A generally Z-shaped foot pad support member 34, as viewed in FIG. 3, is coupled at one extremity to seat support 22. In most modern wheelchairs the coupling is made in a manner which permits member 34 to be pivoted out of the users way or removed altogether if desired. The upper surface of the other extremity of member 34 remote from support 22 is provided with a foot pad or rest 36. Pad 36 can be mounted on member 34 is any suitable fixed or pivotable manner.

An elongated arm rest 38 is mounted on the upwardly facing surface of arm rest support 24 adjacent to upright 18.

What has been described so far is the structure of one side assembly 12. The other side assembly 14 is identical but constructed in right hand side orientation and identical structure is identified so far as shown in the various views by similar numbers in the 100 series.

As is undoubtedly well known most modern light weight wheelchairs are constructed to be readily portable in an automobile or other conveyance and must, therefore, be collapsible or foldable to reduce overall size for storage. Such requirements entail joining the chain sides 12 and 14 with some type of pivotable or foldable supports which will give the chair adequate support when in use and fold readily for storage and transportation. This problem is even more complex in the present invention where all those requirements must be met without interfering with the ability to roll the chair over a common water closet.

FIG. 1 discloses the manner in which the above requirement is structurally fulfilled. A pair of slidable collars 140 are mounted one above the other on support 18 and another pair of collars 140 are mounted one above the other on support 118 above respectively the seat support 22 and 122 (not shown) and below arm rest support 24 and 124 (not shown). Collars 140 are adapted to be pivotally coupled to one end of a link 142. Each link 142 is pivotally coupled to another link 142 intermediate the ends of said links and also at the extremities thereby forming a structural support between supports 18 and 118 which is foldable by the pivoting action of the links 142 relative to each other.

The extremities of the outermost links 142 as viewed in FIG. 1 are pivotally coupled to the collars 140 which are slidable on supports 18 and 118. When the chair is folded the collars 140 move apart to the maximum length of one of the links 142 and the links are then able to pivot relative to each other folding together as the chair is manually folded. Manual unfolding and separating of sides 12 and 14 causes the collars 140 to draw closer together and the links 142 to pivot relative to each other to expand the support across the back of the chair between supports 18 and 118. If additional stability is required one collar 140 on support 18 and one on support 118 can be fixed against sliding movement. Ordinarily the two lower collars 140 would be the ones selected. Set screws or other suitable means (not shown) could be used for this purpose. If desired all four collars 140 could be releasably fixable in a similar manner to contribute additional stability when the chair is in use.

A pair of fixed pivot tabs 144 are provided, one on the inwardly facing surface of lower support 26 adjacent to caster assembly 32, and one on the inwardly facing surface of lower support 126 (hidden) adjacent caster assembly 132 (not shown). A pair of elongated links 146 and 148 are provided each of said links being pivotally mounted at one end thereof to a tab 144 and the said links 146 and 148, are pivotally interconnected intermediate their ends to each other.

A support assembly 150 extends between sides 18 and 118 immediately adjacent to the joinder of arm rest supports 24 and 124 respectively with seat supports 22 and 122 on the side of said joinders towards supports 18 and 118 respectively. Obviously arm rest support 124 and seat support 122 are not shown in the drawings but their structure can be well understood from foregoing description.

Assembly 150 consists of channel members 152 and 154. Channel member 152 is pivotally connected at one end to seat support 22 and channel member 154 is pivotally connected at one end to seat support 122. Channel members 152 and 154 are pivotally interconnected at their ends remote from seat supports 22 and 122 respectively so that the channels face in opposite directions. The channel of member 152 faces rearwardly relative to said chair and the channel of member 154 faces forwardly relative to said chair. The pivotal connection between links 152 and 154 is provided with a detent such that the links 152 and 154 cannot pivot relative to each other beyond a straight line or 180° orientation. Pins 155 are mounted at the ends of links 146 and 148 remote from tabs 144 in opposite directions to ride respectively in the channels of channel members 152 and 154 respectively.

A back support 157 is coupled to and extends between supports 18 and 118 intermediate handles 20 and 120 (not shown) and the uppermost collars 140 on supports 18 and 118 respectively for the purpose of supporting the back of the wheelchair occupant.

Referring now specifically to FIGS. 2 and 4 of the drawings a seat assembly is disclosed and generally identified by the numeral 156. Assembly 156 includes a seat support channel 158 extending between and coupled to support 18 and arm rest support 24 spaced immediately above and parallel to seat support 22. A second seat support channel 158 extends between and is coupled to support 118 and arm rest support 124 spaced immediately above and parallel to seat support 122. A padded cushion section 160 is mounted in each seat support channel 158. Cushion sections 160 rest on channel members 152 and 154 respectively and can be fastened thereto if desired for further support. A second support (not shown) may be provided across the back of the chair between supports 18 and 118 comprised of an assembly of pivoted channel member like channel members 152 and 154 similarly mounted for pivotal motion and stopping 180° relationship of the channel members immediately below lower collars 140 on supports 18 and 118 if additional seat cushion support is required.

As will be seen from FIGS. 2 and 4 cushions sections 160 are each of a generally rectangular shape in horizontal plan view and comprise the left and right one-third of the total seat area relative to chair side assemblies 12 and 14 and the area there-between when the chair 10 is in open position for use, leaving a central seat area of the remaining one-third.

The seat assembly 156 as shown and described above leaves each cushion 160 with an exposed side 162 facing toward the other cushion 160. Each cushion side 162 is provided with an elongated cushion side plate 164 as shown in FIG. 4 which is provided with an elongated channel 166 extending from a point adjacent one end of side plate 164 to a point adjacent the other end of side plate 164. At the end of side plate 164 disposed rearwardly of seat assembly 156 each side plate 164 is provided with a second channel 168 joined with channel 166 and extending therefrom to the top of side plate 164.

A central cushion member 170 generally rectangular in horizontal plan view is provided to fit between cushions 160. The elongated side faces 172 and 174 of central cushion 170 are provided with pins 176 which will slide within channels 166 and 168. This structure permits drawing cushion section 170 forwardly relative to chair 10 so that the chair user can eliminate from a sitting position in chair 10 when chair 10 is over a water closet 178 as is shown in FIG. 5 of the drawings. Since central cushion section 170 is somewhat flexible, channels 168 permit removal of cushion 170 to facilitate the collapsing of the chair 10 when it is desired to transport it.

It can therefore be seen that the structure described accomplishes the objects and advantages of the present invention previously set forth herein which are intended to be covered by the scope of the appended claims.

I claim:

1. An improved laterally collapsible wheelchair having left and right side structures including vertical and horizontal support members, each of said side structures provided with rotatably mounted rear wheels and forwardly mounted caster wheel assemblies, said wheelchair including an upper, foldable elongated horizontal support structures interconnecting said left and right side structures, and interpivoted elongated members, each said elongate member being pivotally connected at one end to a lower portion of one of said side structures and pivotally connected at the opposite end to the foldable support structure adjacent the other of said side structures, said interpivoted elongate members lying in a vertical plane forwardly of the vertical plane in which said caster wheel assemblies are disposed, seat structure coupled to said side structures and extending therebetween, said seat structure including a plurality of cushion sections, at least one of said cushion sections being pliable and coupled to the remainder of said sections for slidable withdrawal forwardly relative to said chair from the seat structure by a user of said chair.

2. The structure as set forth in claim 1, wherein said seat structure is provided with three cushion section lying in side by side generally parallel orientation from side to side of said chair, the center cushion section being coupled to side sections by pins mounted in said center section adapted to slide in channels provided in the side sections, said side sections being fixed to said chair sides such that the center section may be slidably moved relative to said side sections and forwardly relative to said chair.

3. The structure as set forth in claim 2, wherein said channels terminate adjacent the forwardmost margin of said side cushion sections to limit the forward slidable movement of said center cushion section relative to said side cushion sections and the chair.

4. The structure as set forth in claim 3, wherein said side cushion sections are provided with a second channel interconnecting the first channel and the upper margins of said side sections for removal of said pins from side channels upon rearward and then upward sliding movement of said center cushion relative to said side cushions for full removal by said chair user of said center cushion from between said side cushions.

5. The invention as set forth in claim 4, wherein said foldable elongated horizontal support structure interconnecting said left and right side structures includes a plurality of links pivotally coupled to said left and right side structures and to each other for pivotal movement relative to each other in said vertical plane, and detent structure on at least one of said links to prevent further pivotal movement of said links relative to each other when said side structures are in a position spaced apart and parallel to each other the maximum distance mechanically possible from the pivoting action of said links.

6. The structure as set forth in claim 5, wherein said detent structure on at least one of said links is disposed to bar further pivotal movement of said links in said vertical plane in a downward direction relative to said chair.

7. The structure as set forth in claim 6, wherein link gate horizontal support structure is disposed between said side structures and coupled thereto for pivotal movement of its member links relative to each other and said side structures, said link gate structure being coupled to said side supports above the horizontal plane in which said seat structure is disposed and generally above the rotatable mounting of said rear wheels to said side structure.

* * * * *